US007864015B2

(12) United States Patent
Hansen et al.

(10) Patent No.: US 7,864,015 B2
(45) Date of Patent: Jan. 4, 2011

(54) FLUX CHANNELED, HIGH CURRENT INDUCTOR

(75) Inventors: Thomas T. Hansen, Yankton, SD (US); Jerome J. Hoffman, Yankton, SD (US)

(73) Assignee: Vishay Dale Electronics, Inc., Columbus, NE (US)

( * ) Notice: Subject to any disclaimer, the term of this patent is extended or adjusted under 35 U.S.C. 154(b) by 889 days.

(21) Appl. No.: 11/380,293

(22) Filed: Apr. 26, 2006

(65) Prior Publication Data

US 2007/0252669 A1 Nov. 1, 2007

(51) Int. Cl.
*H01F 5/00* (2006.01)

(52) U.S. Cl. ..... 336/200

(58) Field of Classification Search ..... 336/65, 336/83, 200, 232

See application file for complete search history.

(56) References Cited

U.S. PATENT DOCUMENTS 4,538,132 A * 8/1985 Hiyama et al. ..... 336/221
4,583,068 A 4/1986 Dickens et al.
6,392,525 B1 5/2002 Kato et al.
6,621,397 B2 * 9/2003 Hsu ..... 336/96
7,023,313 B2 * 4/2006 Sutardja ..... 336/178
7,525,406 B1 * 4/2009 Cheng ..... 336/83
2004/0113741 A1 * 6/2004 Li et al. ..... 336/212

FOREIGN PATENT DOCUMENTS

EP 1 288 975 A2 3/2003
EP 1 548 764 A1 6/2005

OTHER PUBLICATIONS

PCT/US2006/032305, International Search Report, Vishay Dale Electronics, Inc., Aug. 18, 2006, pp. 1-5.

* cited by examiner

*Primary Examiner*—Tuyen Nguyen
(74) *Attorney, Agent, or Firm*—Volpe and Koenig, PC

(57) ABSTRACT

A flux-channeled high current inductor includes an inductor body having a first end and an opposite second end and a conductor extending through the inductor body. The conductor includes a plurality of separate channels through a cross-sectional area of the inductor body thereby directing magnetic flux inducted by a current flowing through the conductor into two or more cross-sectional areas and reducing flux density of a given single area. The inductor body may be formed of a first ferromagnetic plate and a second ferromagnetic plate. The inductor may be formed from a single component magnetic core and have one or more slits to define inductance. The inductor may be formed of a magnetic powder. A method is provided for manufacturing flux-channeled high current inductors.

15 Claims, 10 Drawing Sheets

FLUX CHANNELED, HIGH CURRENT INDUCTOR

BACKGROUND OF THE INVENTION

Low profile inductors, commonly defined as inductors having a profile less than about 10 mm are in existence today in the form of ferrites with unique geometries and pressed iron powder around a wound coil. Ferrite based low profile inductors have an inherent limitation of magnetic saturation at relatively low levels of current. When magnetic saturation occurs, inductance value decreases dramatically.

Pressed iron inductors allow for much higher input current than ferrite inductors, but have the limitation of producing high core losses at high frequencies (such as frequencies greater than 100 kHz). What is needed is an efficient means to provide inductance at high frequencies allowing high input currents.

BRIEF SUMMARY OF THE INVENTION

It is therefore a primary, object, feature, or advantage of the present invention to improve upon the state of the art.

It is a further object, feature, or advantage of the present invention to provide an inductor which has lower core losses at high ripple currents (>5 A) and frequencies (>100 kHz) in a thin package yet also have the high saturation current performance of powdered iron.

Another object, feature, or advantage of the present invention is to use adhesive film thickness to adjust inductance characteristics.

Yet another object, feature, or advantage of the present invention is to utilize a split conductor geometry that divides magnetic flux thus reducing flux density in thin sections of the magnetic material.

A further object, feature, or advantage of the present invention is to employ a layer of high saturating magnetic material to channel DC induced flux from the layer of low saturating magnetic material increasing inductance and saturation current capability and thereby also providing lower high frequency losses by using the low saturating ferrite material.

Another object, feature, or advantage of the present invention is to use a thin adhesive film to set inductance level of the part and join the ferromagnetic plates together.

Yet another object, feature, or advantage of the present invention is to allow for use of multiple conductor loops to define inductance and/or increase saturation current.

A further object, feature, or advantage of the present invention is to increase the capability of an inductor to effectively handle more DC while maintaining inductance.

One or more of these and/or other objects, features, or advantages of the present invention will become apparent from the description of the invention that follows.

According to one aspect of the present invention, a flux-channeled high current inductor is provided. The inductor includes an inductor body having a first end and an opposite second end and a conductor which extends through the inductor body. The conductor includes a plurality of separate channels through a cross-sectional area of the inductor body thereby splitting magnetic flux induced by a current flowing through the conductor and reducing flux density. A first and a second portion of the conductor wraps around a portion of the first end to provide first and second contact pads and a third portion of the conductor wraps around a portion of the second end to provide a third contact pad.

The inductor body may be formed by a first ferromagnetic plate and a second ferromagnetic plate. Alternatively, the inductor body may be manufactured from a single component magnetic core having either a slit between channels or slits between each side of the inductor and a corresponding channel. Alternatively, the inductor may be formed from a pressed magnetic powder.

According to one aspect of the present invention, a flux-channeled high current inductor is provided. The inductor includes a first ferromagnetic plate and a second ferromagnetic plate. There is a conductor between the first ferromagnetic plate and the second ferromagnetic plate, the conductor having a plurality of separate channels through a cross-sectional area of the inductor thereby splitting magnetic flux induced by a current flowing through the conductor and reducing flux density. There may be an adhesive film between the first ferromagnetic plate and the second ferromagnetic plate, the adhesive film having a thickness used to define inductance characteristics of the inductor.

Another embodiment of the invention adds the use of high saturating ferromagnetic sheets. The first sheet portion disposed on the first ferromagnetic plate and a second sheet portion disposed on the second ferromagnetic plate. Preferably, the first sheet portion and the second sheet portion each have a permeability higher than the permeability of the first and second ferromagnetic plates such that DC induced magnetic flux is shunted away from the ferromagnetic plates and flows through the sheet.

Another aspect of the invention provides for a method of manufacturing a flux-channeled high current inductor. The method includes providing an inductor body having a first end and an opposite second end and positioning a conductor extending through the inductor and forming a plurality of separate channels through a cross-sectional area of the inductor thereby splitting magnetic flux induced by a current flowing through the conductor and reducing flux density. The method may further include wrapping a first and second portion of the conductor extending from the first end of the inductor body around a portion of the first end to form a first contact pad and a second contact pad. The method may further include wrapping a third portion of the conductor, the third portion extending from the second end of the inductor body around a portion of the second end to form a third contact pad. The inductor body may include a first ferromagnetic plate and a second ferromagnetic plate. The inductor body may be a single component magnetic core. Where the inductor body is a single component magnetic core, the method may further include cutting a single slit in a middle portion of the inductor body between two of the separate channels or cutting a first slit between a first side of the inductor body and a first channel and cutting a second slit between a second side of the inductor body and a second channel. The inductor body may also be a pressed magnetic powder inductor.

According to another aspect of the invention, a method of manufacturing a flux-channeled high current inductor is provided. The method includes providing a first ferromagnetic plate and a second ferromagnetic plate and depositing a conductor between the first ferromagnetic plate and the second ferromagnetic plate to thereby form a plurality of separate channels through a cross-sectional area of the inductor thereby splitting magnetic flux induced by a current flowing through the conductor and reducing flux density. The method may further comprise using an adhesive film between the first ferromagnetic plate and the second ferromagnetic plate to connect the first ferromagnetic plate and the second ferromagnetic plate, the adhesive film having a thickness used to define inductance characteristics of the inductor. At least one of the ferromagnetic plates may have grooves, the conductor positioned within the grooves. The method may further include applying a first sheet portion on the first ferromagnetic plate and a second sheet portion on the second ferromagnetic plate, the first sheet portion and the second sheet portion each having a permeability higher than a permeability of the first ferromagnetic plate and the second ferromagnetic plate such that in operation of the inductor, DC induced magnetic flux is shunted through the sheets away from the first ferromagnetic plate and the second ferromagnetic plate.

DETAILED DESCRIPTION OF THE PREFERRED EMBODIMENT

The present invention includes an efficient, low profile, high current inductor. In one embodiment of the present invention, two ferromagnetic plates are spaced by a thin adhesive film. The adhesive film is preferably comprised of a layer of solid B staged epoxy manufactured to a tightly controlled thickness. Alternate forms of thin adhesive films have solid reinforcements such as glass fiber or KAPTON (polyimide) tape. The use of the adhesive film has a dual role in the effectiveness of the component. Adhesive thickness is selected to raise or lower the inductance of the part. Small adhesive film thickness creates an inductor with a high inductance level. A thick adhesive film reduces the inductance of the part and increases magnetic saturation resistance to high input current. Thus, the adhesive film thickness can be selected to tailor the inductance of the part for a specific application. The second role of the adhesive is to permanently bind the parts together thereby making the assembly robust to mechanical loads.

Ferromagnetic plates can be made from any magnetically soft material such as ferrite, molypermalloy (MPP), Sendust, Hi Flux or powder iron. The preferred material is ferrite as it has low core losses at high frequencies and is the least expensive of the aforementioned materials.

Figure 1:
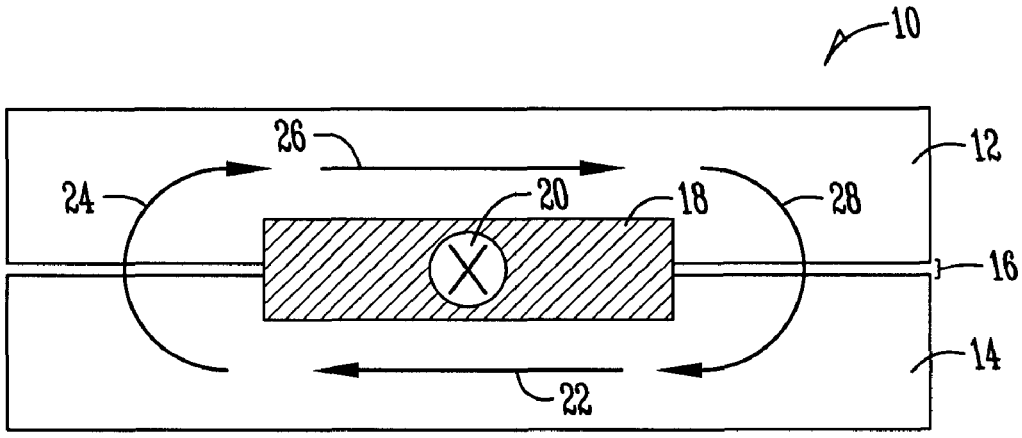
Fig.1 (PRIOR ART)
FIG. 1 is a cross-section of a prior art inductor without flux channeling.

Prior art shows us a single strip of copper can be placed between two ferrite parts to create an inductor. While this is effective in creating low value, high frequency inductors, it limits the amount of input current the inductor can handle without saturating. The primary cause of saturation comes from the fact that all magnetic flux induced by the copper flows through narrow cross-sectional areas. FIG. 1 illustrates the flux pattern in a single copper strip inductor.

In FIG. 1, an inductor 10 has a first ferromagnetic plate 12 and a second ferromagnetic plate 14. There is a spacing 16 between the first ferromagnetic plate 12 and the second ferromagnetic plate 14. The magnetic flux induced by a current through the single strip copper conductor 18 is split between each plate 12, 14. Input current 20 is shown using notation to indicate that the current is flowing into the page. Arrows 22, 24, 26, 28 indicate the direction of magnetic flux induced by the current 20 through the conductor 18. Note that all the magnetic flux induced by the current in the copper conductor 18 flows through narrow cross-sectional 22, 26 areas thereby becoming the primary cause of saturation.

Figure 2:
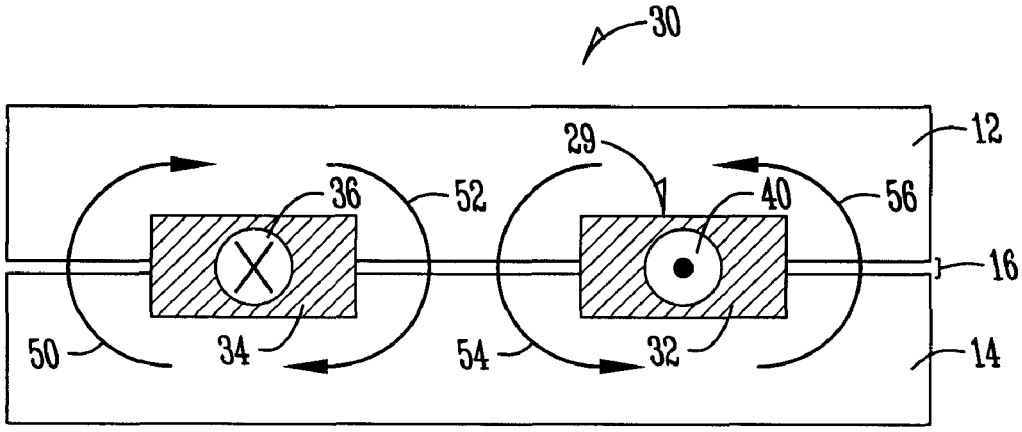
FIG. 2 is a cross-section of one embodiment of a flux-channeled inductor of the present invention.

The present invention uses a technique to channel magnetic flux generated by an applied current through two or more cross-sectional areas and therefore reduce the magnetic field density in any one cross-sectional area. FIG. 2 illustrates the manner in which magnetic flux flows through the ferromagnetic core material of one embodiment of an inductor 30 of the present invention. As shown in FIG. 2, the conductor 29 is shaped like a U and is between a first ferromagnetic plate 12 and a second ferromagnetic plate 14. The U-shaped conductor 29 has a first channel 32 and a second channel 34. Input current 36 is shown directed into the page and exit current 40 is shown coming out of the page. Arrows 50, 52, 54, and 56 are used to show the induced flux. Channeling the magnetic flux in this manner significantly increases the amount of current that can be applied to the inductor. The magnetic flux induced by a current through the conductor is split forced between each half of the inductor 30. Magnetic levels are thus half of a single strip of copper due to this channeling. Several conductor loops can be put into the inductor to further reduce the magnetic flux density through any one cross-sectional area. Regardless of whether single or multiple loops are used, the geometry of the conductor and the plates is selected so as appropriately channel the flux.

Figure 3:
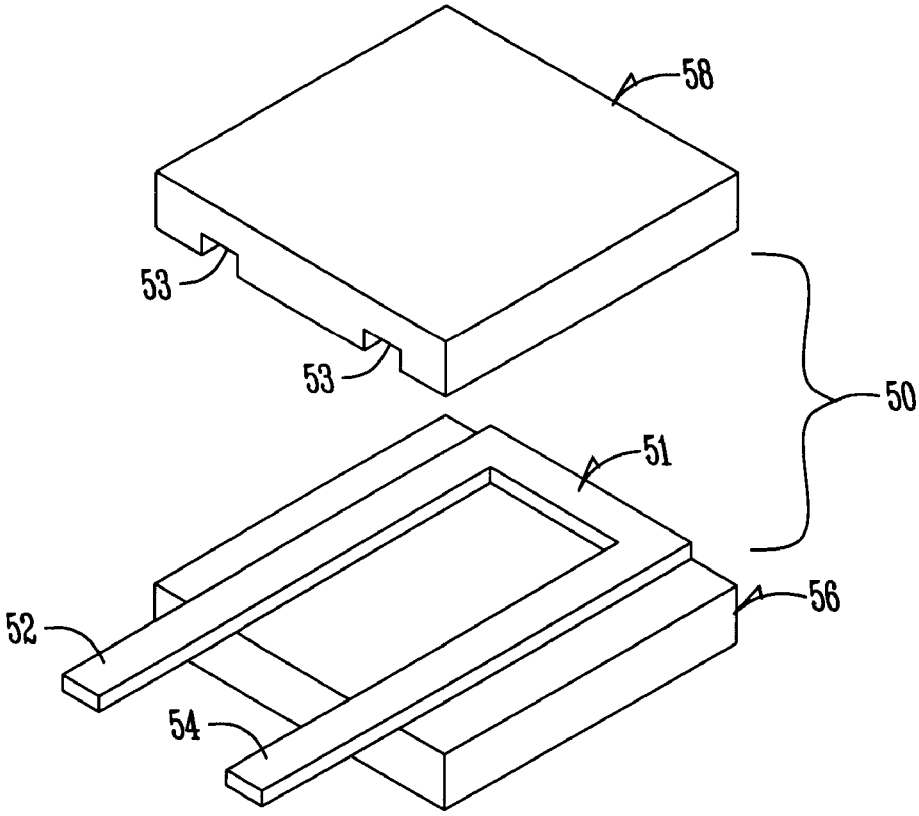
FIG. 3 is a perspective view of one embodiment of a flux-channeled inductor of the present invention with ferromagnetic plates being separated.

FIG. 3 illustrates another embodiment of the present invention. Here, two ferromagnetic plates 56, 58 are combined together by a distance set by the thickness of a thin adhesive film (not shown). Embedded in one plate 58 is a channel 53 whereby a conductor 51 is placed. A single loop conductor inductor 50 is shown in FIG. 3, however, the present invention also provides for using multiple conductor loop inductors.

Electrical current enters the left conductor 52, flows through the component, and exits from the right conductor 54, for example. Magnetic flux is generated using the right hand rule with the thumb pointing in the direction of the current. The right hand rule shows the interior of the loop has magnetic flux flowing down into the lower ferromagnetic plate 56 and exiting outside the loop into the top ferromagnetic plate 58. As can be seen, the total magnetic flux is reduced by a factor of two in the upper 58 and lower 56 plates. Inductance of the part 50 is increased due to the extended length and geometry of the conductor 51.

Figure 4:
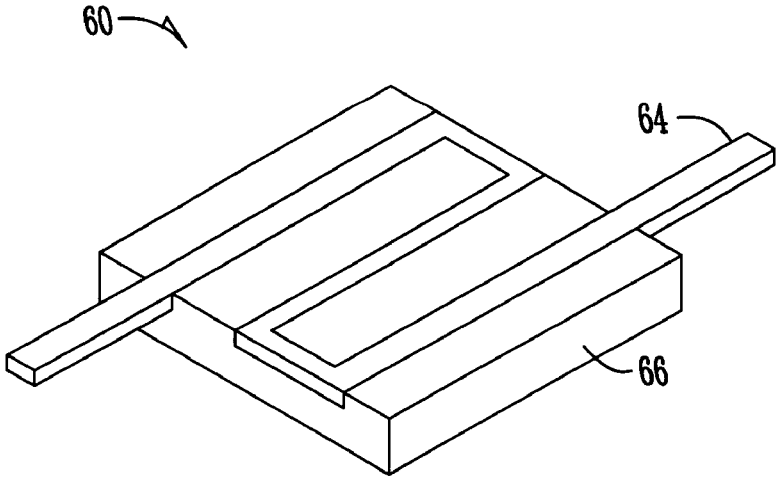
FIG. 4 is a perspective view of one embodiment of a double loop conductor inductor.

As shown in FIG. 4, the inductor 60 can include a conductor 64 with multiple loop geometry disposed on a ferromagnetic plate 66. With multiple loop geometry, the inductance and magnetic saturation handling capabilities are increased, as there are multiple magnetic flux paths.

Figure 5:
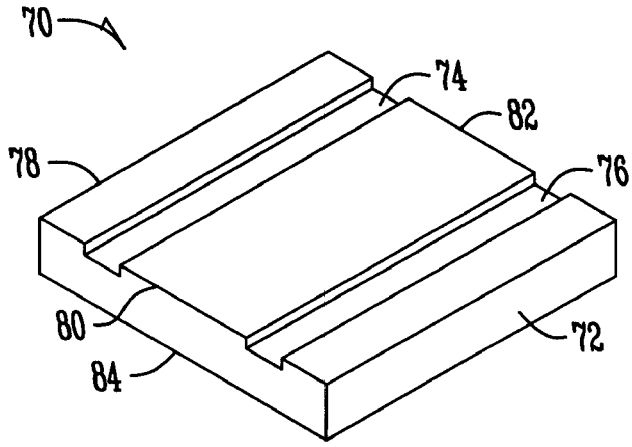
FIG. 5 is a perspective view of one embodiment of a ferromagnetic plate for use in a single loop conductor inductor.
Figure 6:
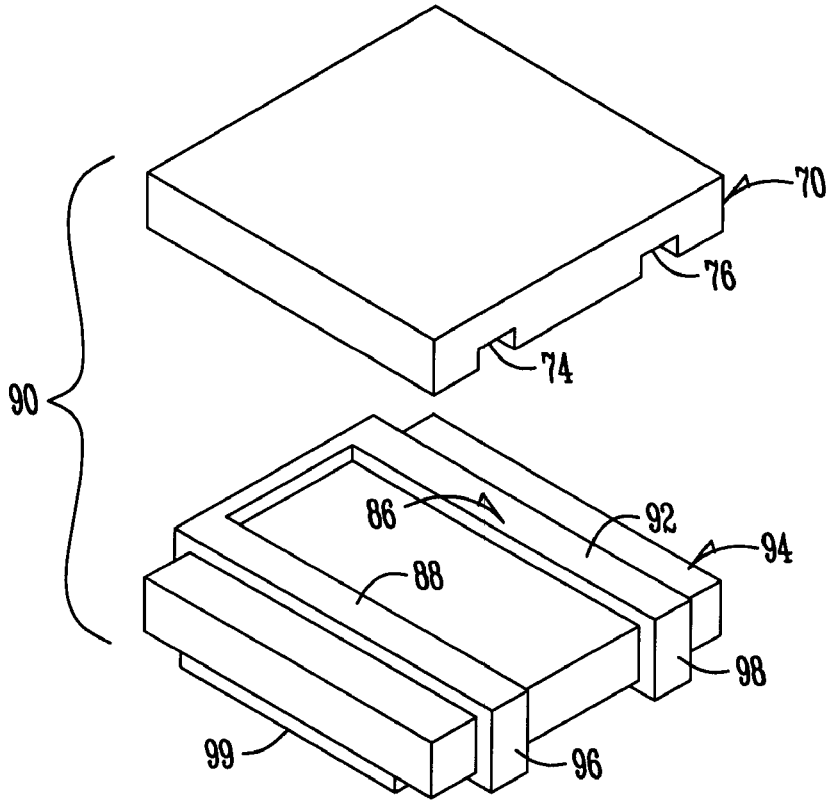
FIG. 6 is a perspective view of one embodiment of a low profile, high current inductor of the present invention.
Figure 7:
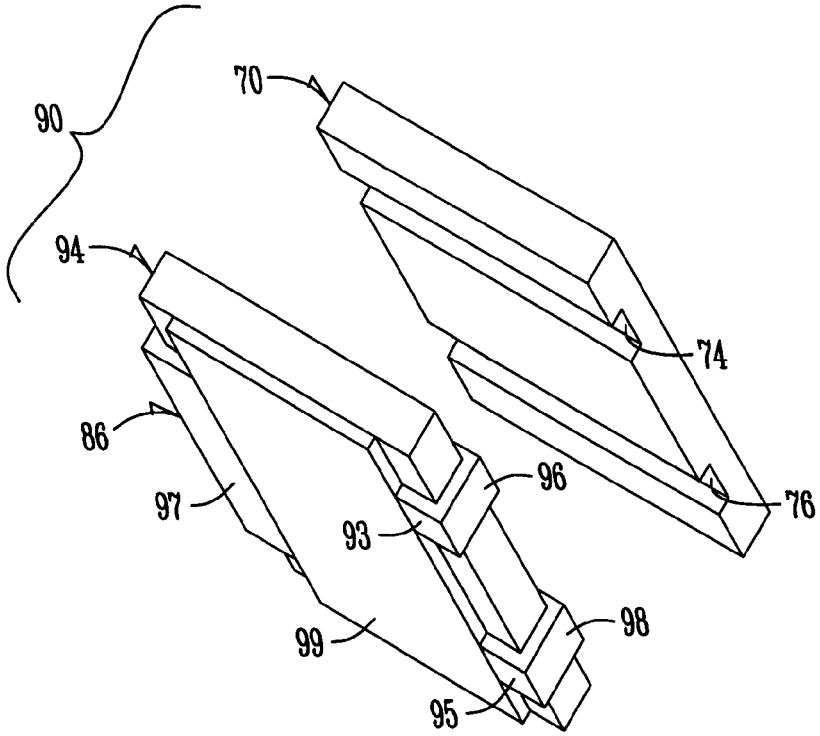
FIG. 7 is a perspective view of one embodiment of low profile, high current inductor.

FIGS. 5, 6 and 7 represent one embodiment of an inductor 70 and 90 for implementation on a circuit board. A first ferromagnetic plate 70 is shown with a top portion 78 and a bottom portion 84. Grooves 74 and 76 are cut in the ferromagnetic plate 70. As shown best in FIG. 5, grooves 74 and 76 extend from a first side 80 of the ferromagnetic plate 70 to an opposite second side 82 of the plate 70. Opposite third and fourth sides 78, 72 of the ferromagnetic plate 70 are also shown.

The conductor 86 has a first segment 92 and a second segment 88 and, as shown in FIG. 7, the conductor 86 is bent around a second ferromagnetic plate 94 to form three soldering surfaces 93, 95, 97. Two conductor terminals 93, 95 are for applying power to the inductor 90. The wider terminal 97 is for soldering the component 90 to a non-conducting place on the electrical board to provide support.

The present invention contemplates using various methodologies to construct an inductor. To construct a flux channeled, high current inductor, one side of the inductor is made from manganese-zinc by TAK Ferrite and is placed into a fixture. Additional ferrite components are put in the fixture to thereby create the capability for manufacturing a few components to a large array of 150 parts or more. A strip of a copper conductor is set on top of the placed ferrite components with the shaped conductor portion fitting into the grooves of the components. A film adhesive such as Dupont's PYRALUX Bondply is placed over the conductor and ferrite components. A second inductor component is used in the assembly. It is a manganese-zinc ferrite manufactured by TAK Ferrite. Multiple ferrite components are placed in a second fixture. Each ferrite component is precisely located such that it mates with the first ferrite component of the other fixture. Both fixtures containing the two ferrite components, conductor and film adhesive are mated together. A load is applied to the fixture assembly to create a 50-200 psi mating pressure on each part. The assembly is heated to approximately 160-200 degrees Celsius for up to 1 hour to activate the curing agents in the adhesive and bond the components together. A laser, shear or knife cuts the excess adhesive from the array and prints a part number onto each inductor part. Strips of conductor/inductor part assembly are removed and fed through a machine to form the conductor around the part. The parts are then tested for performance and packaged, ready for shipment. Of course, the present invention contemplates variations in this process as may be appropriate for a particular inductor or as may be appropriate in a particular manufacturing environment.

DC Shunt Inductor

According to another embodiment of the present invention, a DC shunt inductor version of a flux-channeled inductor is provided. The flux channeled, high current inductor increases the capability of an inductor to effectively handle more DC while maintaining inductance.

Figure 8:
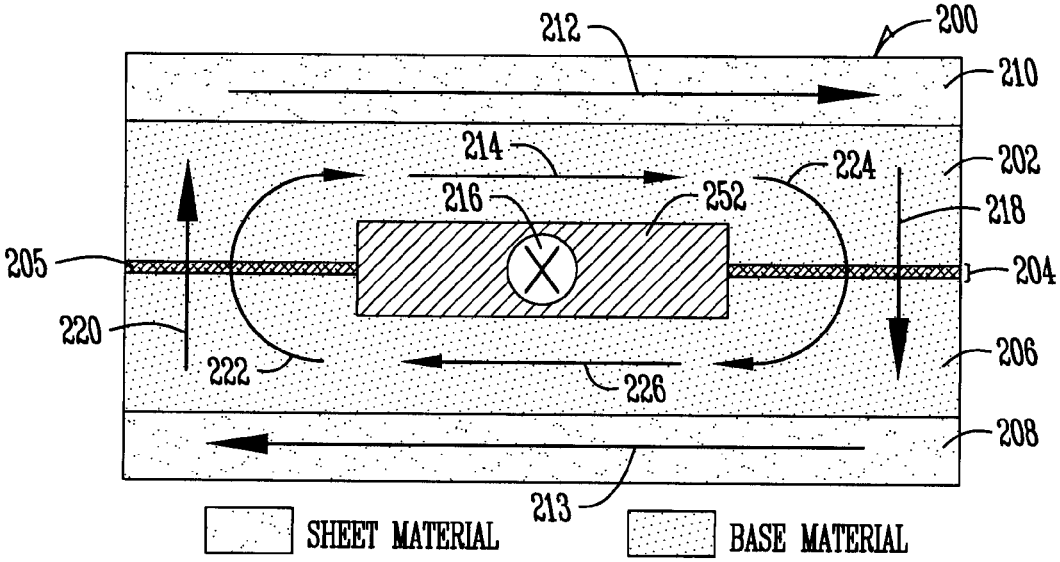
FIG. 8 is a cross-section of one embodiment of a flux-channeled DC shunt inductor.
Figure 9:
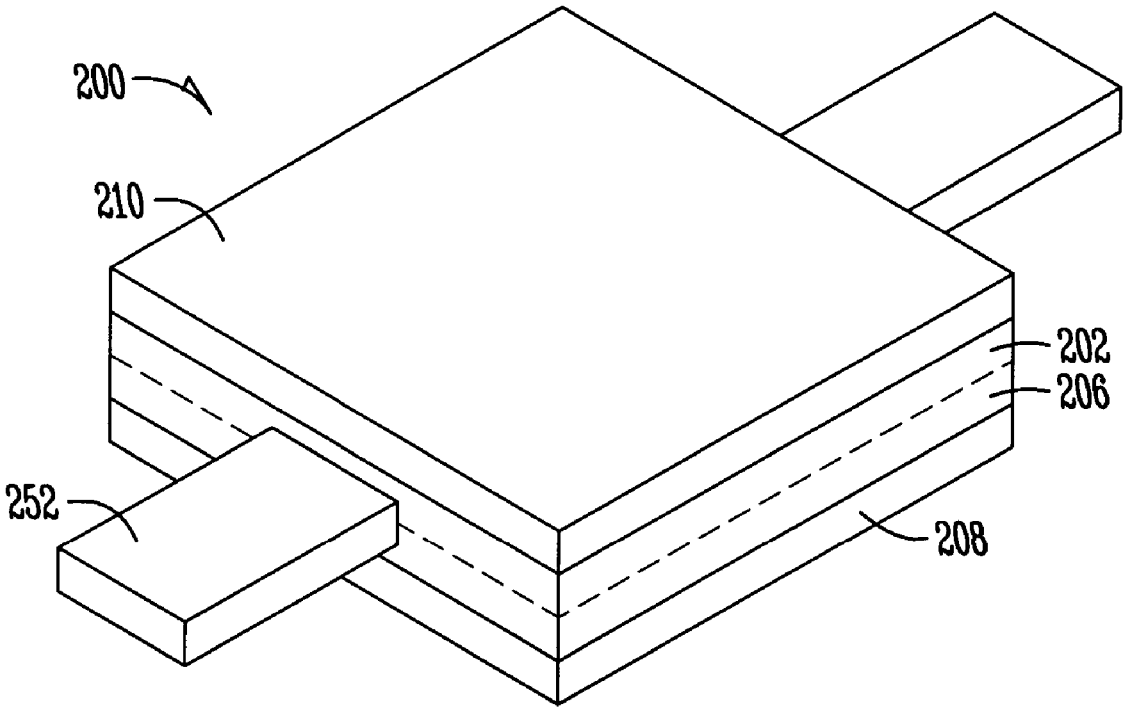
FIG. 9 is the completed assembly of a flux-channeled DC shunt inductor.

An extremely efficient, low profile, high current inductor comprises two plates of low saturating (base) material such as ferrite spaced via a thin film adhesive as shown in FIG. 8 and FIG. 9. A thick strip of a conductor, preferably copper, is placed through the magnetic plates thereby creating a low DC resistance. High magnetic saturating sheets such as silicon iron are placed on top and below the low saturating magnetic plates. Conventional wisdom would say that the addition of such plates would dramatically reduce performance as high saturating materials are generally very electrically conductive and can only be operated in a very thin form below 10 kHz. This design actually uses this particular quality to enhance performance.

In FIG. 8, an inductor 200 is shown having a first ferromagnetic sheet 208 and a second ferromagnetic sheet 210. Ferromagnetic sheets can be made from any magnetically soft material with high saturation properties such as iron cobalt, pure iron, carbon steel, silicon iron or nickel iron alloys. The preferred material is silicon iron as it is electrically conductive (<500 micro-ohm cm), has high magnetic permeability (>4000), high magnetic saturation (>16,000 Gauss) and is generally less expensive than alternatives.

Prior art shows that a single strip of copper can be placed between two ferrite parts to create an inductor. While this is effective in creating low value, high frequency inductors, it limits the amount of input current the inductor can handle without saturating. The primary cause of saturation comes from the fact that all magnetic flux induced by the applied current flows through narrow cross-sectional areas of the ferrite plates.

A ferromagnetic sheet 208, 210 with high magnetic saturation characteristics and a relative permeability at least two times that of the ferromagnetic plate base material 202, 206 is used. The high permeability attracts the magnetic flux created by DC in the conductor 252 to flow through the sheet instead of the base material. Effectively the DC induced magnetic flux is shunted away from the low saturating base material. The nature of the sheet material prevents time variant (harmonic, >1 kHz) induced magnetic flux to pass through it. The reason is strong eddy currents are induced at the surface and effectively prevent the magnetic flux from penetrating into the material. The harmonic magnetic flux is then primarily confined to the low saturating base material, while the DC generated magnetic flux flows through the ferromagnetic sheet. Many applications have 70 percent or more of peak current in an inductor as DC and the remaining 30 percent is due to harmonic fluctuations. A sheet material having up to 10 times more magnetic flux carrying capacity than the base material drastically reduces the DC induced magnetic flux in the base. This property allows the flux channeled inductor to carry significantly more DC than prior art inductors. Another significant feature of this design is the DC resistance of the inductor is exceedingly low and may be up to 10 times less than prior art designs of similar size.

In a preferred embodiment, the design uses a sheet material with relative magnetic permeability of greater than about 5 to several hundred times the base permeability. The higher the sheet material permeability, the more DC induced magnetic flux is taken away from the low saturating base material. The sheet material can be effectively used if it is non-conducting. Non-conducting sheet material will perform nearly as well but may have inductance values not as constant as an electrically conducting sheet. A conducting sheet prevents the harmonic magnetic flux from coupling into the high permeability material and thus, stabilizes the inductance value over a range of DC input.

Magnetic flux, flows in the ferromagnetic material within the area inside the conductor, and is coupled together to increase inductance and then split via the return path increasing magnetic saturation of the part. Effectively the flux is coupled together and decoupled, which has not been achieved in any known inductors to date.

Finite element modeling was performed to compare the performance of DC shunt inductors relative to standard inductors of the same size. The following table summarizes the results.

| Type | Dimensions (mm) | Inductance (nH) | Saturation (A) (Applied DC resulting in an inductance 80% of no current value) |
|---|---|---|---|
| Traditional Ferrite Only | 4 × 10 × 10.5 | 539 | 11 |
| Ferrite-DC Shunt | 4 × 10 × 10.5 | 532 | 23 |

According to another aspect of the present invention, a methodology is provided for manufacturing a flux channeled, high current inductor with DC shunt, such as the inductor 200 shown in FIG. 8 and FIG. 9.

Figure 10:
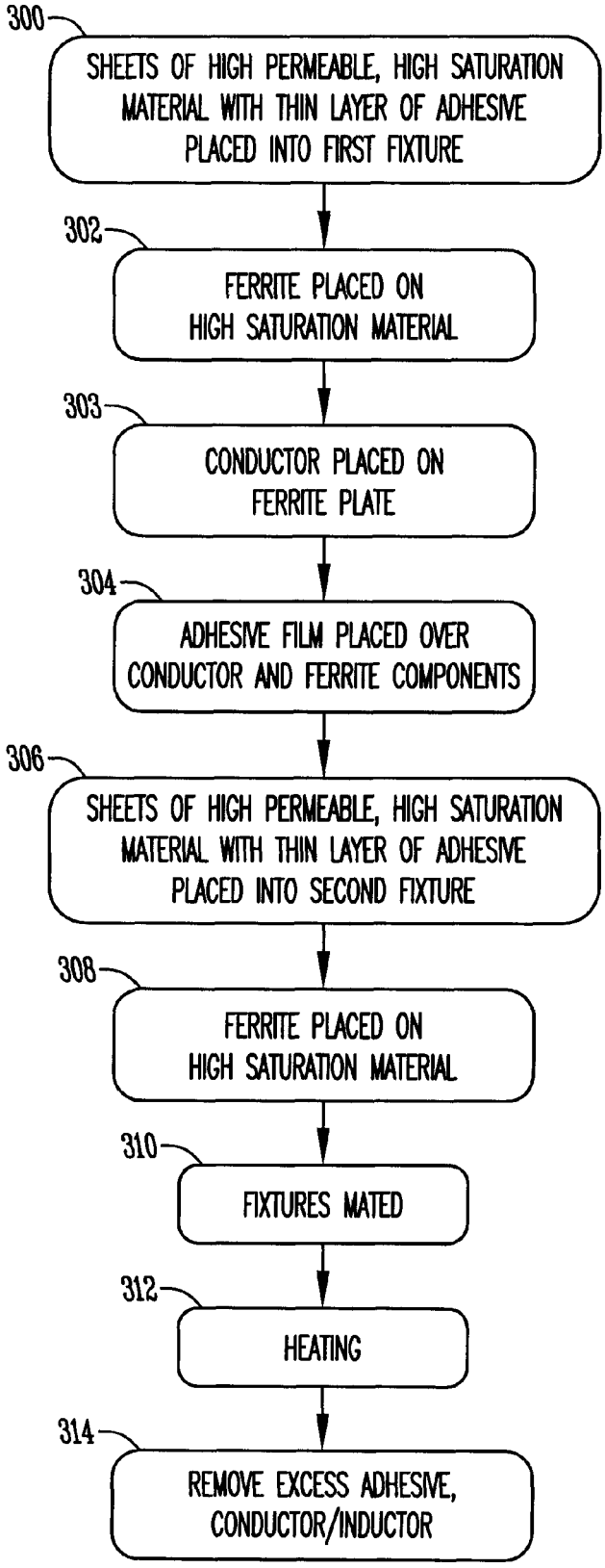
FIG. 10 is a flow diagram illustrating one method of manufacturing an inductor according to the present invention.

To manufacture a flux-channeled, high-current inductor DC shunt, thin sheets of high permeability, high saturation material such as silicon-iron with a very thin layer of adhesive are placed into a fixture as shown in step 300 of FIG. 10. Next, in step 302, manganese-zinc ferrites manufactured by TAK Ferrite are placed on top of the high saturating material. A conductor 252 is placed on the ferrite plate in step 303. An adhesive film 205, such as Dupont's PYRALUX Bondply, is placed over the conductor and ferrite components in step 304. Thin sheets of high permeability, high saturating material such as silicon-iron with a very thin layer of adhesive are placed into a second fixture in step 306. Other examples of possible sheet materials include iron, cobalt, steel, etc. The sheet material is electrically conductive, preferably under 500 microhms/meter resistance. A second ferrite component is used in the assembly as shown in step 308. Preferably it is a manganese-zinc ferrite manufactured by TAK Ferrite. Multiple ferrite components are placed in the second fixture on top of the high saturating materials. Both fixtures containing the two high saturation and ferrite components, conductor and film adhesive are mated together in step 310. A load to create a 50-200 psi mating pressure on each part is applied to the fixture assembly. The assembly is heated in step 312 to approximately 160-200 degrees Celsius for up to 1 hour to activate the curing agents in the adhesive and bond the components together. In step 314, excessive adhesive and conductor is removed. A laser, shear or knife cuts the excess adhesive from the array and prints a part number onto each inductor part. Strips of conductor part assembly are removed by being fed through a machine removing excess copper and bending the conductor around the part. The parts are tested for performance and packaged, ready for shipment.

Figure 11:
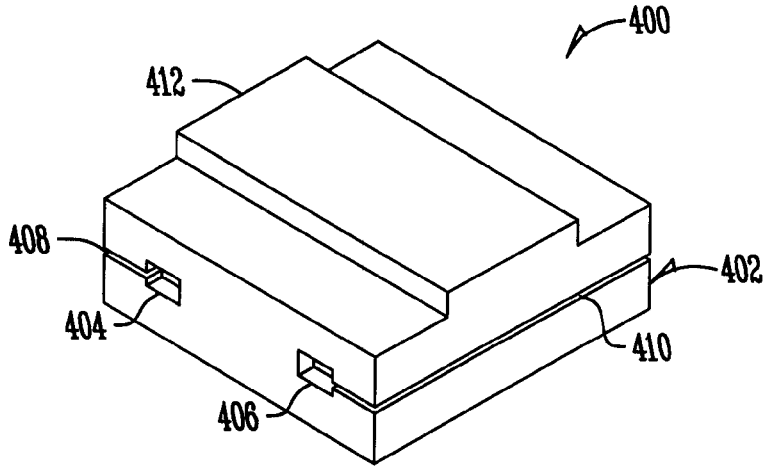
FIG. 11 is a perspective view showing one embodiment of a side gapped inductor of the present invention without a conductor present.
Figure 12:
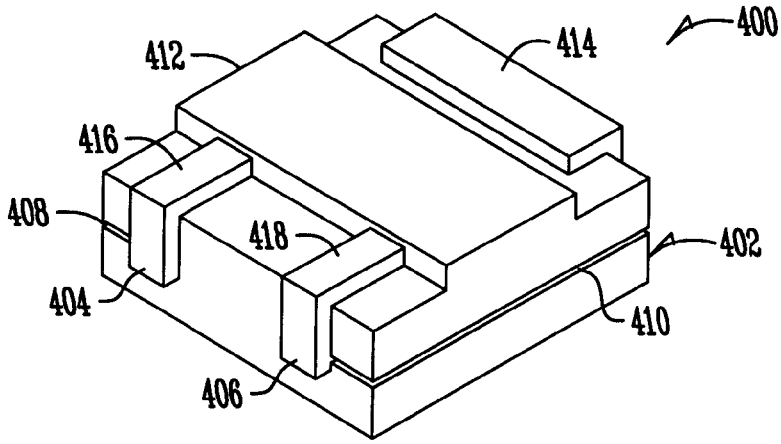
FIG. 12 is a perspective view showing one embodiment of a side gapped inductor of the present invention with a conductor present.

Additional embodiments of the present invention are disclosed in FIG. 11 to FIG. 15. FIG. 11 is a perspective view showing one embodiment of a side gapped inductor of the present invention. The inductor 400 of FIG. 11 is manufactured from a single component magnetic core. Magnetic flux is channeled the same way as in the two-piece flux channeled inductor. Two slits 408, 410 are cut into the side of the inductor to introduce a gap which dictates the inductance of the part. FIG. 11 shows the opening for the conductor having a first section 404 and a second section 406 which are placed through the part. The conductor then preferably bends around the part to form electrical contact pads. This is shown in FIG. 12 where there are contact pads 414, 416, and 418.

Figure 13:
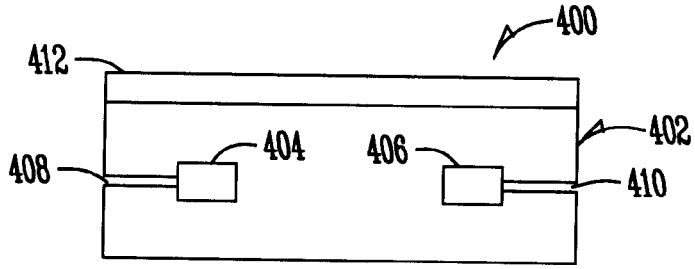
FIG. 13 is a front view of one embodiment of a side gapped inductor of the present invention.

FIG. 13 illustrates a front view of the side gapped inductor 400. The first section of the conductor 404 is spaced apart from the second section of the conductor 406. A first slit 408 is shown through the side of the inductor 400 to the first section of the conductor 404. A second slit 410 is shown through the side of the inductor 402 to the first section of the conductor 406.

Figure 14:
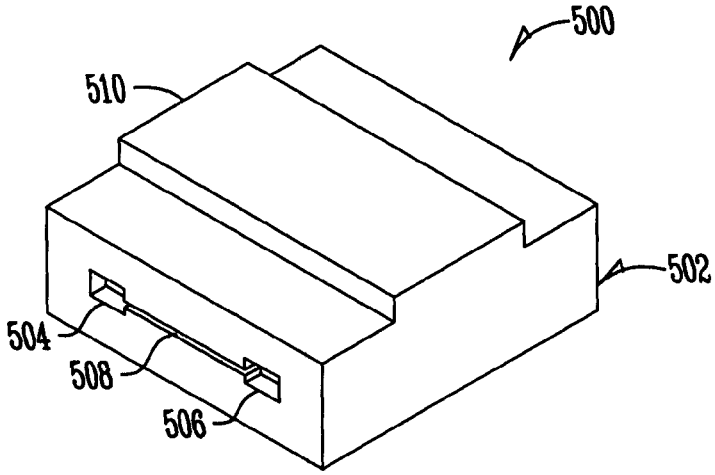
FIG. 14 is a perspective view of one embodiment of a center gapped inductor of the present invention without a conductor present.
Figure 15:
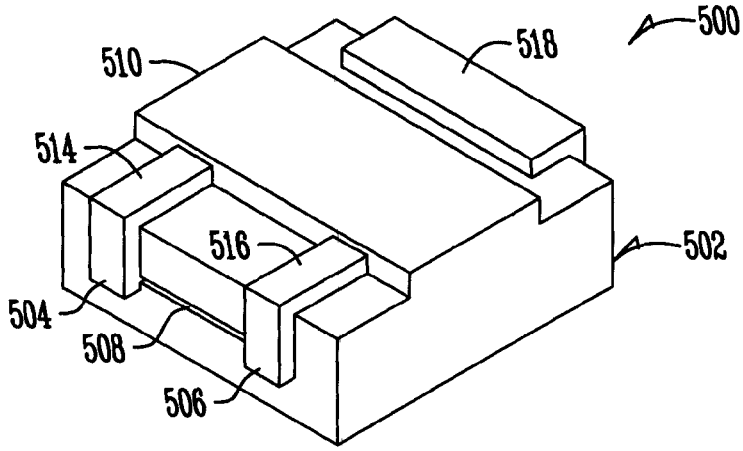
FIG. 15 is a perspective view of one embodiment of a center gapped inductor of the present invention with a conductor present.
Figure 16:
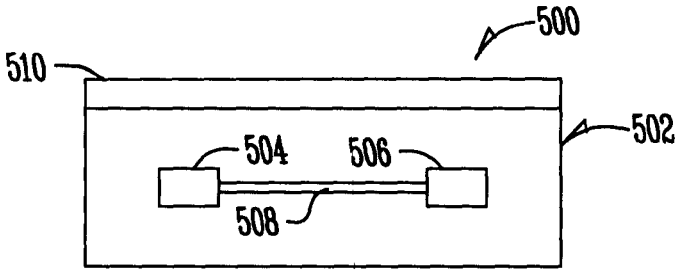
FIG. 16 is a front view of one embodiment of a center gapped inductor of the present invention.

Another embodiment of the present invention is shown in FIG. 14 through FIG. 16. A device 500 is shown which has a single component magnetic core 502. A conductor having portions 504 and 506 is placed through the part and bent around the part to form electrical contact pads 514, 516, 518 on either side of a top surface 510 of the magnetic core 502. Magnetic flux is channeled the same way as the two-piece flux-channeled inductor. A single slit 508 is cut into the middle of the inductor to introduce a gap dictating the inductance of the part. In FIG. 16, a front view is shown. Note that a gap 508 is present between each conductor portion 504, 506.

Figure 17:
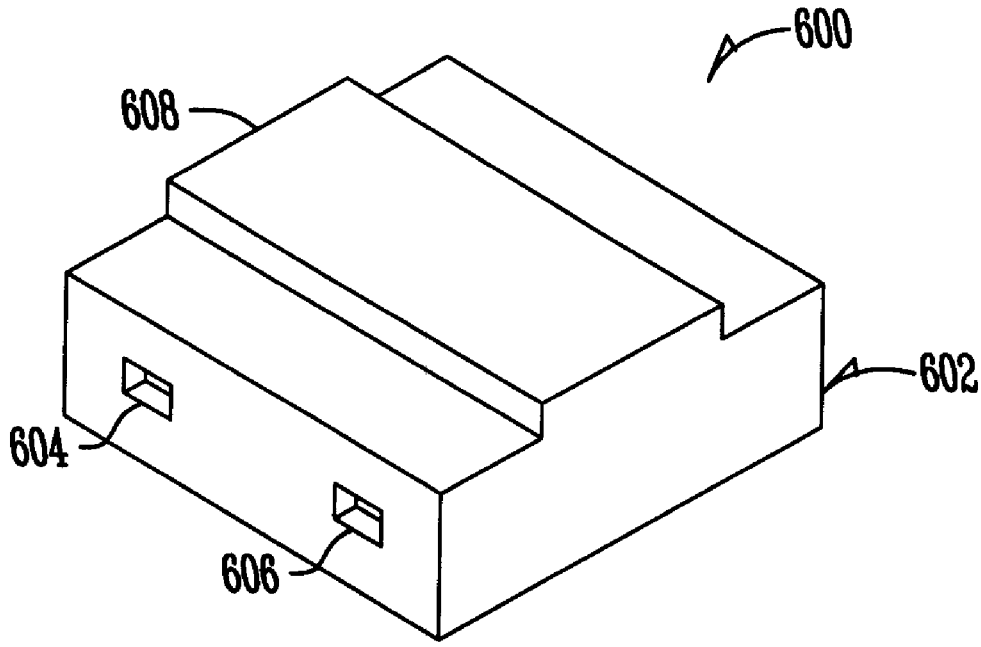
FIG. 17 is a perspective view of one embodiment of a pressed magnetic powder embodiment of the present invention without the conductor present.
Figure 18:
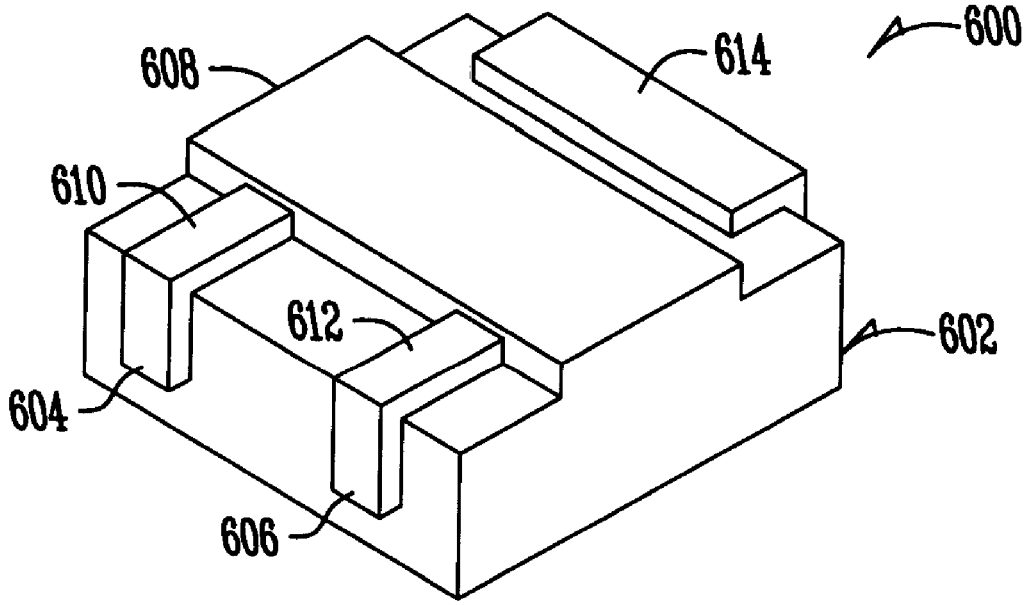
FIG. 18 is a perspective view of one embodiment of a pressed magnetic powder embodiment of the present invention with a conductor present.

Another embodiment of the present invention is shown in FIG. 17 and FIG. 18. The part 600 is manufactured by pouring a granulated magnetic powder over the U shaped conductor having legs 604 and 606. A compressive force compacts the powder into a magnetic solid. The conductor 614 is bent around the part to form electrical contact pads 610, 612, and 614. Magnetic flux is channeled the same way as in the two-piece flux-channeled inductor. The pressed magnetic powder consists of a distributed gap between particles which effectively acts like a gap to dictate part inductance.

Figure 19:
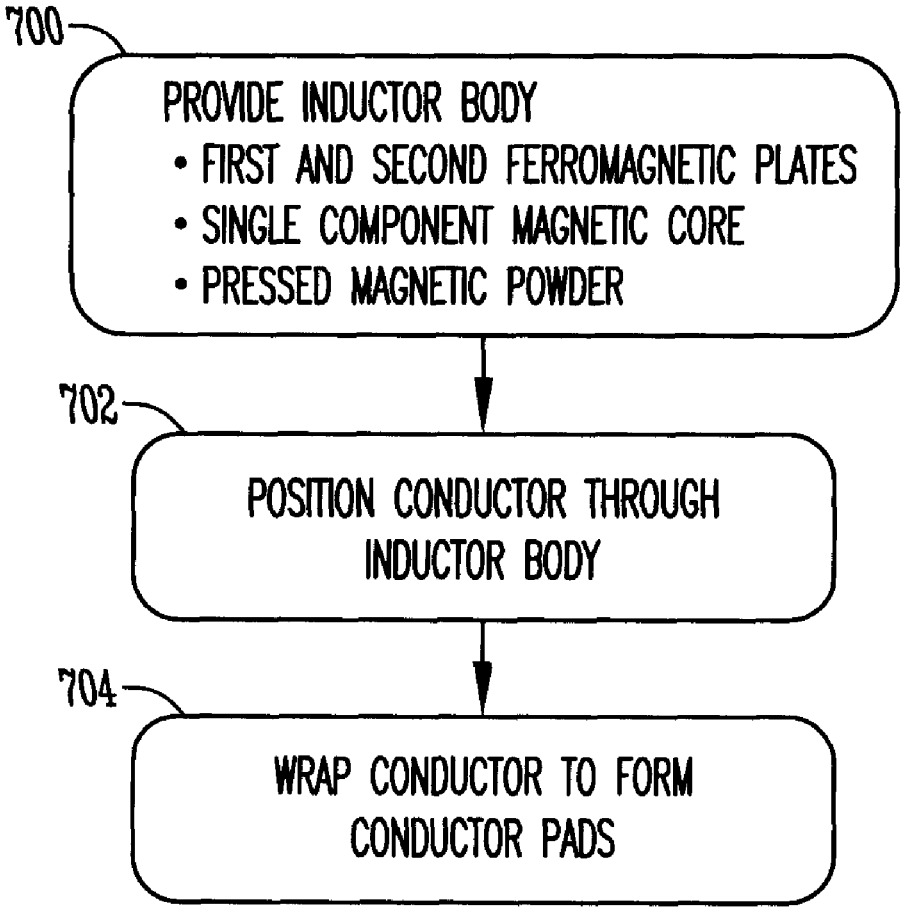
FIG. 19 is a diagram illustrating one embodiment of methodology of the present invention.

FIG. 19 illustrates one embodiment of the methodology of the present invention. In step 700 an inductor body is provided. The inductor body may be formed using first and second ferromagnetic plates. The inductor may a single component magnetic core. The inductor body may be formed from pressed magnetic powder. In step 702, a conductor is positioned such that it extends through the inductor body. In step 704 portions of the conductor are wrapped around opposite ends of the inductor body to form contact pads. It is to be understood that where the inductor is a single component magnetic core, one or more slits are cut through the inductor body as previously described.

Thus, it should be apparent that the present invention provides for improved inductors and methods of manufacturing the same. The present invention contemplates numerous variations in the types of materials used, manufacturing techniques applied, and other variations which are within the spirit and scope of the invention.

What is claimed is:

1. A flux-channeled high current inductor, comprising:

an inductor body having a first end and an opposite second end;

a single conductor extending through the inductor body, the conductor comprising a first channel having a first current direction through a first cross-sectional area of the inductor body, and at least a second channel having an opposite second current direction through a second cross-sectional area of the inductor body, the first and second channels arranged in a U-shaped configuration such that magnetic flux induced by a current flowing through the conductor is directed in opposite directions in the first and second cross-sectional areas of the inductor body and flux density of a given single area of the inductor body is reduced.

2. The flux-channeled high current inductor of claim 1 wherein a first and a second portion of the conductor wraps around a portion of the first end to provide first and second contact pads and a third portion of the conductor wraps around a portion of the second end to provide a third contact pad.

3. The flux-channeled high current inductor of claim 1 wherein the inductor body is formed by a first ferromagnetic plate and a second ferromagnetic plate, the conductor between the first ferromagnetic plate and the second ferromagnetic plate.

4. The flux-channeled high current inductor of claim 1 wherein the inductor body being manufactured from a single component magnetic core.

5. The flux-channeled high current inductor of claim 4 further comprising a slit in the inductor body.

6. The flux-channeled high current inductor of claim 5 wherein the slit being position between two of the plurality of channels.

7. The flux-channeled high current inductor of claim 4 further comprising a first slit and a second slit in the inductor body wherein the first slit being between a first of the plurality of channels and a first side of the inductor body and the second slit being between a second of the plurality of channels and an opposite second side of the inductor body.

8. The flux-channeled high current inductor of claim 1 wherein the inductor comprises a pressed magnetic powder.

9. A flux-channeled high current inductor, comprising:

a first ferromagnetic plate;

a second ferromagnetic plate;

a single conductor between the first ferromagnetic plate and the second ferromagnetic plate, the conductor comprising a first channel having a first current direction through a first cross-sectional area of the ferromagnetic plates, and at least a second channel having an opposite second current direction through a second cross-sectional area of the ferromagnetic plates, the first and second channels arranged in a U-shaped configuration such that magnetic flux induced by a current flowing through the conductor is directed in opposite directions in the first and second cross-sectional areas of the ferromagnetic plates and flux density of a given single area of the ferromagnetic plates is reduced.

10. The flux-channeled high current inductor of claim 9 further comprising an adhesive film between the first ferromagnetic plate and the second ferromagnetic plate, the adhesive film having a thickness used to define inductance characteristics of the inductor.

11. The flux-channeled high current inductor of claim 9, further comprising a first sheet portion disposed on the first ferromagnetic plate and a second sheet portion disposed on the second ferromagnetic plate and wherein the first sheet portion and the second sheet portion each having a permeability higher than a permeability of the first ferromagnetic plate and the second ferromagnetic plate such that DC induced magnetic flux is attracted away from the first ferromagnetic plate and the second ferromagnetic plate.

12. The flux-channeled high current inductor of claim 9 wherein each of the first and the second ferromagnetic plates being comprised of ferrite.

13. The flux-channeled high current inductor of claim 9 wherein a profile of the flux-channeled high current inductor is less than about 10 millimeters.

14. The flux-channeled high current inductor of claim 9 wherein at least one of the first ferromagnetic plate and the second ferromagnetic plate further comprises grooves, the conductor positioned within the grooves.

15. The flux-channeled high current inductor of claim 9 wherein the conductor is solderable.

* * * * *